United States Patent [19]

Tussing

[11] Patent Number: 4,483,088

[45] Date of Patent: Nov. 20, 1984

[54] REVOLVER EMPTY CHAMBER INDICIA

[76] Inventor: Dennis M. Tussing, 1016 S. Siesta La., Tempe, Ariz. 85281

[21] Appl. No.: 462,231

[22] Filed: Jan. 31, 1983

[51] Int. Cl.[3] ..... F41C 27/12

[52] U.S. Cl. ..... 42/1 D; 42/1 A; 42/59; 42/66

[58] Field of Search ..... 42/1 D, 1 A, 1 R, 59, 42/66, 70 R

[56] References Cited

U.S. PATENT DOCUMENTS

| | | | |
|---|---|---|---|
| 790,634 | 5/1905 | Hirsh | 42/1 A |
| 2,100,273 | 11/1937 | Skandera | 42/1 D |
| 3,085,360 | 4/1963 | Robbins et al. | 42/66 |
| 3,208,176 | 9/1965 | Giles | 42/66 |
| 3,407,526 | 10/1968 | Freed | 42/59 |

*Primary Examiner*—Charles T. Jordan

*Attorney, Agent, or Firm*—Weiss & Holloway

[57] ABSTRACT

A safety indicator is disclosed for use with a revolving chamber cylinder of a revolver. The indicator comprises a static marker which is positioned or manufactured on an external surface area of the revolving cylinder. The external area corresponds to the location of a predetermined chamber of the revolving cylinder which is to remain empty while loading the remaining chambers with bullets. After loading the revolving cylinder, the static marker, and hence the empty chamber, is aligned with the barrel and firing hammer of the revolver in accordance with the accepted and safe practice of carrying a revolver with the hammer on an empty chamber to discourage accidental discharge.

4 Claims, 3 Drawing Figures

REVOLVER EMPTY CHAMBER INDICIA

BACKGROUND OF THE INVENTION

1. Field of the Invention

This invention relates generally to safety devices for revolvers and, more specifically, to an indicia for marking a single empty chamber in an otherwise loaded revolver.

2. Description of the Prior Art

Gun safety has long been of primary importance to gun enthusiasts. The many deaths and injuries which occur annually due to the accidental discharge of a bullet from a revolver serve to emphasize the importance of gun safety.

In the past, gun safety was principally geared toward mechanical safety mechanisms which would work in conjunction with the revolvers. For example, U.S. Pat. Nos. 1,842,847, 3,085,360, and 3,208,176 essentially disclosed a mechanism or means for physically blocking or preventing the undesired discharge of a bullet from a fire arm. U.S. Pat. No. 2,100,273 disclosed a mechanical means for indicating when a gun barrel was loaded.

These safety mechanisms were somewhat effective in preventing the accidental discharge of a bullet from a revolver. However, when these mechanisms malfunctioned, either the safety mechanism or the revolver was rendered inoperative. Furthermore these mechanisms were often clumsy and/or inconvenient to employ, causing many gun enthusiasts to use the mechanisms less than they otherwise would have.

The most effective method for assuring safe handling of a gun was simply to keep the revolver unloaded. However, this method was totally inapplicable to situations in which the revolver was about to be used or situations where it was essential to fire the revolver quickly once the need or desire to do so was perceived. In the May 1981 issue of Guns and Ammo magazine, it was stated that the best method for gun safety under these circumstances was to carry the revolver with the hammer down on an empty chamber.

U.S. Pat. No. 3,407,526 disclosed a revolver capable of firing a variety of loads or bullet types and having an indicia on the cylinder of the revolver for indicating what types of loads are in each chamber of the revolver. However, these indicia were limited to identification of chambers compatable with particular load types for use with that particular type of revolver and did not in any way fill the need for indicating a particular empty chamber for use of a standard revolver consistant with the practice of keeping the hammer down on an empty chamber.

Thus a need exists to provide means for rapidly and conveniently identifying the specific empty chamber onto which the hammer was to rest so as to prevent the underside discharge of a bullet therefrom.

SUMMARY OF THE INVENTION

In accordance with one embodiment of this invention, it is an object of this invention to provide an improved means for assuring gun safety.

It is another object of this invention to provide an improved means for assuring gun safety in accordance with the practice of keeping one chamber in the revolving cylinder empty.

It is still another object of this invention to provide an improved means for assuring gun safety which conveniently indicates a particular, predetermined chamber which is to remain empty and which is aligned with the barrel and hammer of the revolver.

In accordance with the above and other objects, the invention comprises means for indicating a particular, predetermined chamber that is to remain empty and aligned with the barrel and hammer of a revolver until it is desired to fire a bullet. The means for indicating the predetermined chamber includes visible static markings on an external surface of a revolving chamber cylinder of the revolver. The external surface area upon which the markings appear corresponds to the position of the predetermined empty chamber.

The foregoing and other objects, features and advantages of this invention will be apparent from the following more particular description of the preferred embodiments of the invention as illustrated in the accompanying drawings.

THE SPECIFICATION

Figure 1:
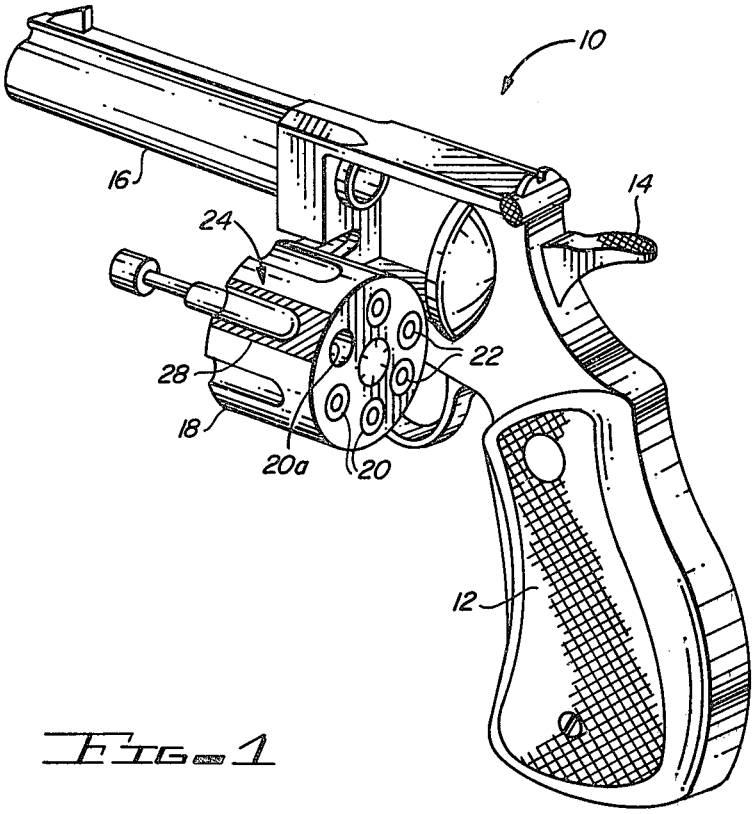
FIG. 1 is a perspective view of a revolver with the chamber in a loading position disclosing an indicia for marking a particular predetermined empty chamber.

Referring to FIG. 1, a revolver is generally designated by the reference number 10. The revolver 10 includes a handle portion 12, a hammer 14, a barrel 16, and a revolving chamber cylinder 18. The revolving cylinder 18 contains a plurality of chambers 20 which can individually be loaded with a bullet 22. The revolving cylinder 18 is usually pivotally mounted, permitting it to be rotated to a loading position, as shown in FIG. 1, so as to facilitate loading of the bullets 22 into the desired chambers 20. Means 24 for indicating a particular, predetermined chamber 20*a* that is to remain empty is located on a portion of the revolving cylinder 18 which corresponds to the position of the predetermined empty chamber 20*a*.

Figure 2:
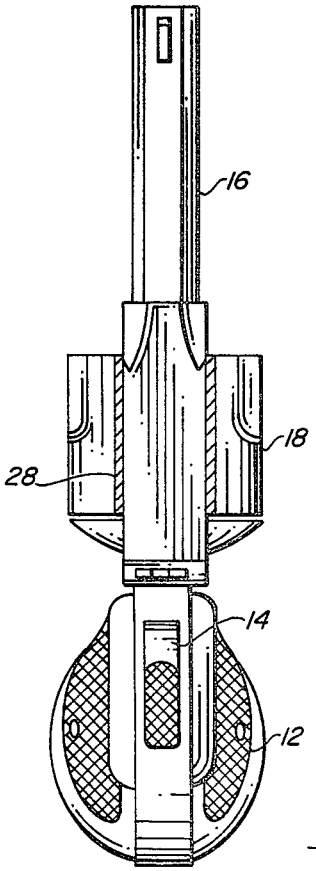
FIG. 2 is a top view of the revolver and indicia of FIG. 1 with the chamber in a firing position, the indicia serving to align the particular predetermined empty chamber with the barrel and hammer in accord with proper gun safety procedures.

Once loaded, the revolving cylinder 18 may be rotated into a firing position, as shown in FIG. 2, wherein a chamber 20 is aligned with the hammer 14 and barrel 16 so as to permit the firing of a bullet 22 therefrom. However, until the discharge of the revolver 10 is desired, the empty chamber indicia 24 should be aligned with the hammer 14 and barrel 16, as shown in FIG. 2, thereby providing a quick, externally visible means for ensuring that the hammer 14 is down on the predetermined empty chamber 20*a*.

Figure 3:
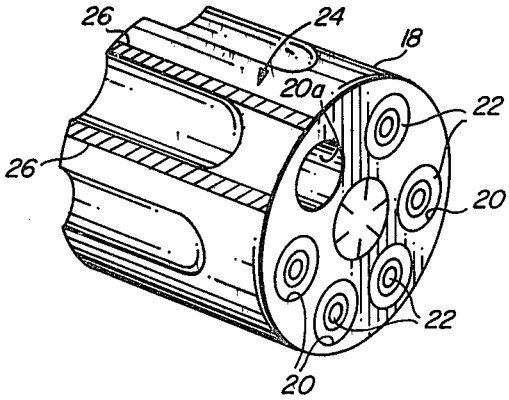
FIG. 3 is a side perspective view of the revolving chamber cylinder of a revolver having the empty chamber indicia thereon.

The empty chamber indicia 24 may comprise any type of mark or notch that is readily visible such as parallel lines 26 as shown in FIG. 3, or the colored block 28 shown in FIG. 1. The indicia 24 outlines the predetermined chamber 20*a*. The empty chamber indicia 24 may be placed on a revolving cylinder 18 of both new and used revolvers 10. The indicia 24 is very effective because it is not mechanical, in no way alters the operation of the revolver 10, and is in accordance with the sound and recognized practice of keeping the hammer 14 down on a predetermined empty chamber 20*a*.

Furthermore, the use of such indicia 24 in no way is mutually exclusive with the prior art type safety mechanisms commonly found on revolvers today.

While the invention has been particularly shown and described with reference to preferred embodiments thereof, it will be understood by those skilled in the art that the foregoing and other changes in form and details may be made therein without departing from the spirit and scope of the invention.

I claim:

1. A safety indicator for use with a revolver having a firing hammer, a barrel and a revolving chamber cylinder, comprising indicia means for statically indicating a predetermined empty chamber in the revolving cylinder and for aligning the predetermined empty chamber with the hammer and the barrel, said indicia means being visibly located on an external surface area of the revolving cylinder corresponding to the predetermined empty chamber and including parallel markings on the external surface area of the revolving cylinder corresponding to the predetermined empty chamber, the parallel markings being separated by a distance which enables the markings to be visible when the predetermined empty chamber is aligned with the firing hammer and chamber.

2. A safety indicator for use with a revolver having a firing hammer, a barrel and a revolving chamber cylinder, comprising a static marker on an external surface area of the revolving chamber cylinder corresponding to a predetermined empty chamber, said static marker including an outline of the predetermined empty chamber on an external surface area of the revolving chamber cylinder, the outline being visible when the predetermined empty chamber is aligned with the firing hammer and the barrel.

3. The safety indicator of claim 2 wherein said outline comprises longitudinal parallel notches on the external surface area of the revolving cylinder.

4. The safety indicator of claim 2 wherein said outline comprises a visibly colored block on the external surface area of the revolving cylinder.

* * * * *